US009432769B1

(12) United States Patent
Sundaram et al.

(10) Patent No.: US 9,432,769 B1
(45) Date of Patent: Aug. 30, 2016

(54) METHOD AND SYSTEM FOR BEAM SELECTION IN MICROPHONE ARRAY BEAMFORMERS

(71) Applicant: Amazon Technologies, Inc., Seattle, WA (US)

(72) Inventors: Shiva Sundaram, Mountain View, CA (US); Amit Singh Chhetri, Santa Clara, CA (US); Ramya Gopalan, Cupertino, CA (US); Philip Ryan Hilmes, San Jose, CA (US)

(73) Assignee: Amazon Technologies, Inc., Seattle, WA (US)

( * ) Notice: Subject to any disclaimer, the term of this patent is extended or adjusted under 35 U.S.C. 154(b) by 13 days.

(21) Appl. No.: 14/447,498

(22) Filed: Jul. 30, 2014

(51) Int. Cl.
*H04R 3/00* (2006.01)

(52) U.S. Cl.
CPC ..... *H04R 3/005* (2013.01); *H04R 2201/40* (2013.01); *H04R 2430/23* (2013.01)

(58) Field of Classification Search
CPC ..... H04R 3/005; H04R 1/406; H04R 1/326; H04R 430/23
USPC ..... 381/92, 56, 59
See application file for complete search history.

(56) References Cited

U.S. PATENT DOCUMENTS

| | | | | |
|---|---|---|---|---|
| 2011/0038486 | A1* | 2/2011 | Beaucoup | H04R 3/005 381/56 |
| 2013/0108066 | A1* | 5/2013 | Hyun | H04R 3/005 381/59 |
| 2013/0148814 | A1* | 6/2013 | Karthik | H04R 3/005 381/56 |

OTHER PUBLICATIONS

Sadjadi et al. "Robust Front-End Processing for Speaker Identification Over Extremely Degraded Communication Channels." Center for Robust Speech Systems (CRSS), The University of Texas at Dallas, Richardson, TX 75080-3021, USA. (May 2013). pp. 7214-7218.

* cited by examiner

*Primary Examiner* — Disler Paul
(74) *Attorney, Agent, or Firm* — Knobbe Martens Olson & Bear LLP

(57) ABSTRACT

Embodiments of systems and methods are described for determining which of a plurality of beamformed audio signals to select for signal processing. In some embodiments, a plurality of audio input signals are received from a microphone array comprising a plurality of microphones. A plurality of beamformed audio signals are determined based on the plurality of input audio signals, the beamformed audio signals comprising a direction. A plurality of signal features may be determined for each beamformed audio signal. Smoothed features may be determined for each beamformed audio signal based on at least a portion of the plurality of signal features. The beamformed audio signal corresponding to the maximum smoothed feature may be selected for further processing.

21 Claims, 8 Drawing Sheets

METHOD AND SYSTEM FOR BEAM SELECTION IN MICROPHONE ARRAY BEAMFORMERS

BACKGROUND

Beamforming, which is sometimes referred to as spatial filtering, is a signal processing technique used in sensor arrays for directional signal transmission or reception. For example, beamforming is a common task in array signal processing, including diverse fields such as for acoustics, communications, sonar, radar, astronomy, seismology, and medical imaging. A plurality of spatially-separated sensors, collectively referred to as a sensor array, can be employed for sampling wave fields. Signal processing of the sensor data allows for spatial filtering, which facilitates a better extraction of a desired source signal in a particular direction and suppression of unwanted interference signals from other directions. For example, sensor data can be combined in such a way that signals arriving from particular angles experience constructive interference while others experience destructive interference. The improvement of the sensor array compared with reception from an omnidirectional sensor is known as the gain (or loss). The pattern of constructive and destructive interference may be referred to as a weighting pattern, or beampattern.

As one example, microphone arrays are known in the field of acoustics. A microphone array has advantages over a conventional unidirectional microphone. By processing the outputs of several microphones in an array with a beamforming process, a microphone array enables picking up acoustic signals dependent on their direction of propagation. In particular, sound arriving from a small range of directions can be emphasized while sound coming from other directions is attenuated. For this reason, beamforming with microphone arrays is also referred to as spatial filtering. Such a capability enables the recovery of speech in noisy environments and is useful in areas such as telephony, teleconferencing, video conferencing, and hearing aids.

Signal processing of the sensor data of a beamformer may involve processing the signal of each sensor with a filter weight and adding the filtered sensor data. This is known as a filter-and-sum beamformer. Such filtering may be implemented in the time domain. The filtering of sensor data can also be implemented in the frequency domain by multiplying the sensor data with known weights for each frequency, and computing the sum of the weighted sensor data.

Altering the filter weights applied to the sensor data can be used to alter the spatial filtering properties of the beamformer. For example, filter weights for a beamformer can be chosen based on a desired look direction, which is a direction for which a waveform detected by the sensor array from a direction other than the look direction is suppressed relative to a waveform detected by the sensor array from the look direction.

The desired look direction may not necessarily be known. For example, a microphone array may be used to acquire an audio input signal comprising speech of a user. In this example, the desired look direction may be in the direction of the user. Selecting a beam signal with a look direction in the direction of the user likely would have a stronger speech signal than a beam signal with a look direction in any other direction, thereby facilitating better speech recognition. However, the direction of the user may not be known. Furthermore, even if the direction of the user is known at a given time, the direction of the user may quickly change as the user moves in relation to the sensor array, as the sensor array moves in relation to the user, or as the room and environment acoustics change.

BRIEF DESCRIPTION OF DRAWINGS

Embodiments of various inventive features will now be described with reference to the following drawings. Throughout the drawings, reference numbers may be reused to indicate correspondence between referenced elements. The drawings are provided to illustrate example embodiments described herein and are not intended to limit the scope of the disclosure.

DETAILED DESCRIPTION

Embodiments of systems, devices and methods suitable for performing beamformed signal selection are described herein. Such techniques generally include receiving input signals captured by a sensor array (e.g., a microphone array) and determining a plurality of beamformed signals using the received input signals, the beamformed signals each corresponding to a different look direction. For each of the plurality of beamformed signals, a plurality of signal features may be determined. For example, a signal-to-noise ratio may be determined for a plurality of frames of the beamformed signal. For each of the plurality of beamformed signals, a smoothed feature may be determined. For example, the smoothed feature may generally be configured to track the peaks of the signal-to-noise ratio signal features but also include time-smoothing (e.g., a moving average) to not immediately track the signal-to-noise ratio signal features when the signal-to-noise ratio signal features drop relative to previous peaks. The beamformed signal corresponding to a maximum of the smoothed features may be determined, and selected for further processing (e.g., speech recognition).

The smoothed feature of a current frame of the beamformed signal may be determined by determining a first product by multiplying the smoothed feature corresponding to a previous frame by a first time constant. A second product may be determined by multiplying the signal feature of the current frame by a second time constant, the second time constant and the first time constant adding up to one. The smoothed feature of the current frame may be determined by adding the first product and the second product.

Beamformed signal selection may also include determining whether voice activity is present in the input signals or beamformed signals. If voice is detected, a beamformed signal may be selected based on the maximum of the smoothed feature. If voice is not detected, the selected beamformed signal may remain the same as a previously-selected beamformed signal.

Various aspects of the disclosure will now be described with regard to certain examples and embodiments, which are intended to illustrate but not to limit the disclosure.

Figure 1:
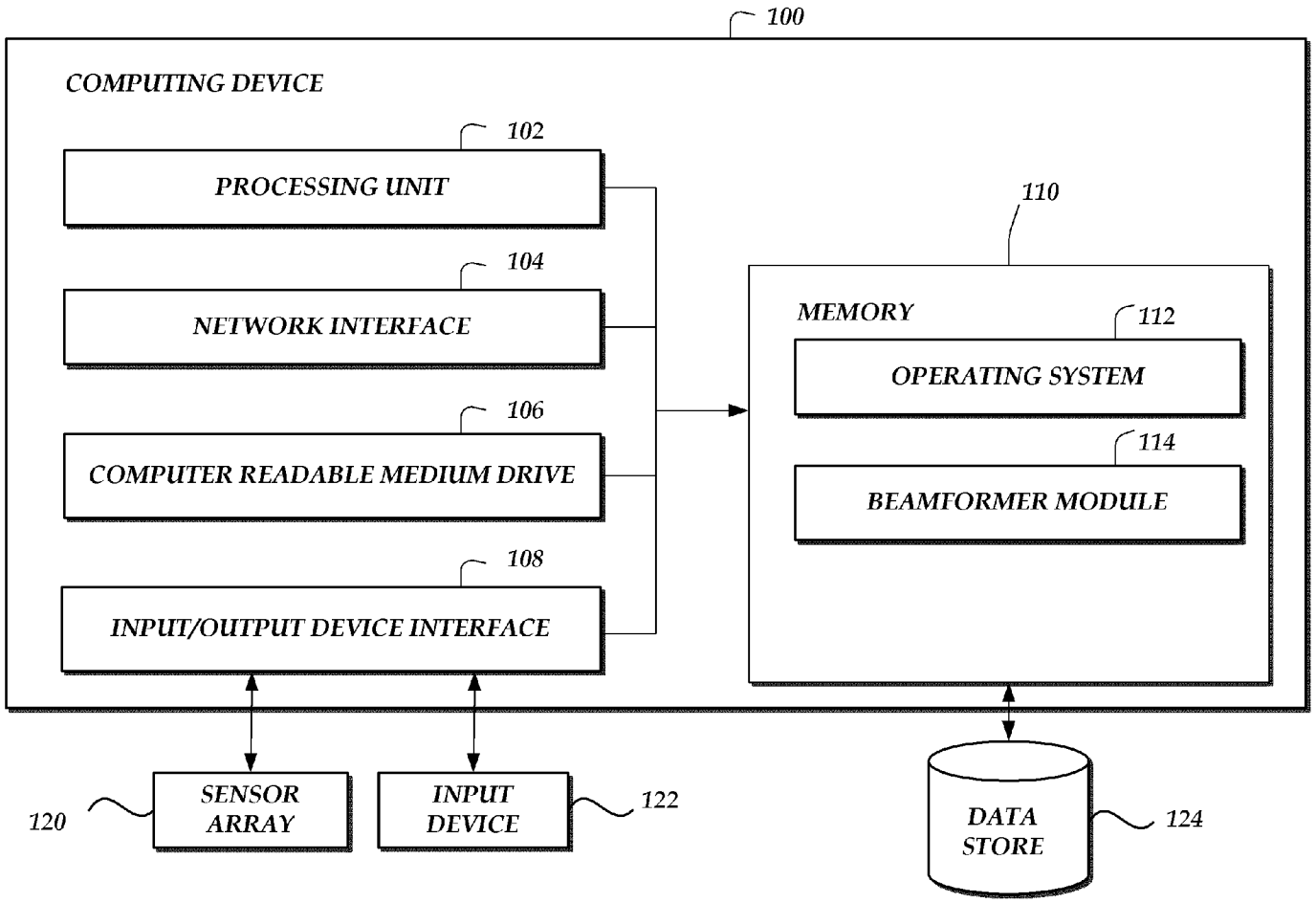
FIG. 1 is block diagram of an illustrative computing device configured to execute some or all of the processes and embodiments described herein.

FIG. 1 illustrates an example of a computing device 100 configured to execute some or all of the processes and embodiments described herein. For example, computing device 100 may be implemented by any computing device, including a telecommunication device, a cellular or satellite radio telephone, a laptop, tablet, or desktop computer, a digital television, a personal digital assistant (PDA), a digital recording device, a digital media player, a video game console, a video teleconferencing device, a medical device, a sonar device, an underwater echo ranging device, a radar device, or by a combination of several such devices, including any in combination with a network-accessible server. The computing device 100 may be implemented in hardware and/or software using techniques known to persons of skill in the art.

The computing device 100 can comprise a processing unit 102, a network interface 104, a computer readable medium drive 106, an input/output device interface 108 and a memory 110. The network interface 104 can provide connectivity to one or more networks or computing systems. The processing unit 102 can receive information and instructions from other computing systems or services via the network interface 104. The network interface 104 can also store data directly to memory 110. The processing unit 102 can communicate to and from memory 110. The input/output device interface 108 can accept input from the optional input device 122, such as a keyboard, mouse, digital pen, microphone, camera, etc. In some embodiments, the optional input device 122 may be incorporated into the computing device 100. Additionally, the input/output device interface 108 may include other components including various drivers, amplifier, preamplifier, front-end processor for speech, analog to digital converter, digital to analog converter, etc.

The memory 110 may contain computer program instructions that the processing unit 102 executes in order to implement one or more embodiments. The memory 110 generally includes RAM, ROM and/or other persistent, non-transitory computer-readable media. The memory 110 can store an operating system 112 that provides computer program instructions for use by the processing unit 102 in the general administration and operation of the computing device 100. The memory 110 can further include computer program instructions and other information for implementing aspects of the present disclosure. For example, in one embodiment, the memory 110 includes a beamformer module 114 that performs signal processing on input signals received from the sensor array 120. For example, the beamformer module 114 can form a plurality of beamformed signals using the received input signals and a different set of filters for each of the plurality of beamformed signals. The beamformer module 114 can determine each of the plurality of beamformed signals to have a look direction (sometimes referred to as a direction) for which a waveform detected by the sensor array from a direction other than the look direction is suppressed relative to a waveform detected by the sensor array from the look direction. The look direction of each of the plurality of beamformed signals may be equally spaced apart from each other, as described in more detail below in connection with FIG. 4.

Memory 110 may also include or communicate with one or more auxiliary data stores, such as data store 124. Data store 124 may electronically store data regarding determined beamformed signals and associated filters.

In some embodiments, the computing device 100 may include additional or fewer components than are shown in FIG. 1. For example, a computing device 100 may include more than one processing unit 102 and computer readable medium drive 106. In another example, the computing device 100 may not include or be coupled to an input device 122, include a network interface 104, include a computer readable medium drive 106, include an operating system 112, or include or be coupled to a data store 124. In some embodiments, two or more computing devices 100 may together form a computer system for executing features of the present disclosure.

Figure 2:
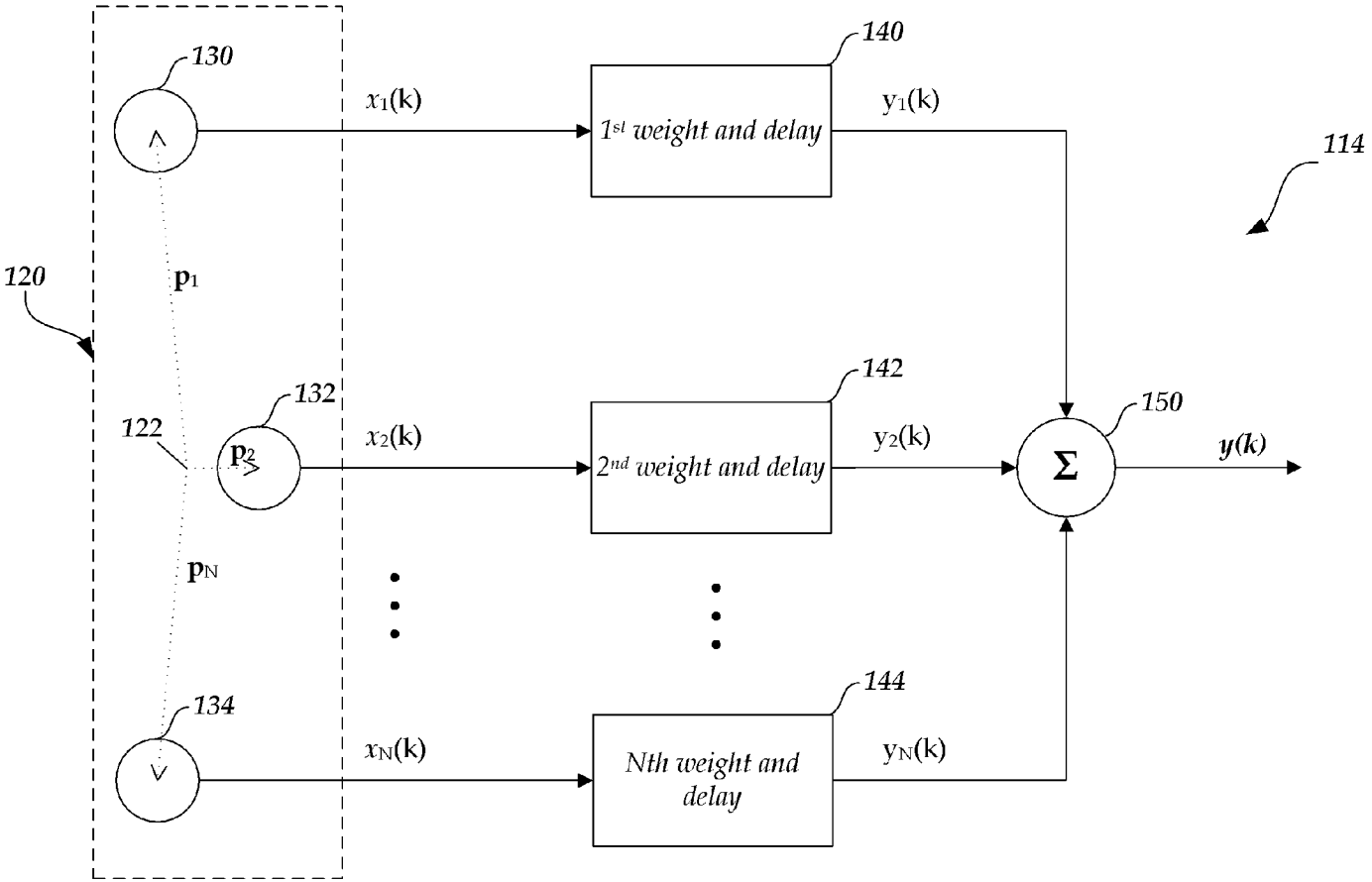
FIG. 2 is a signal diagram depicting an example of a sensor array and beamformer module according to an embodiment.

FIG. 2 is a diagram of a beamformer module that illustrates the relationships between various signals and components that are relevant to beamforming and beamformed signal selection. Certain components of FIG. 2 correspond to components from FIG. 1, and retain the same numbering. These components include beamformer module 114 and sensor array 120. Generally, the sensor array 120 is a sensor array comprising N sensors that are adapted to detect and measure a source signal, such as a speaker's voice. As shown, the sensor array 120 is configured as a planar sensor array comprising three sensors, which correspond to a first sensor 130, a second sensor 132, and an Nth sensor 134. In other embodiments, the sensor array 120 can comprise of more than three sensors. In these embodiments, the sensors may remain in a planar configuration, or the sensors may be positioned apart in a non-planar three-dimensional region. For example, the sensors may be positioned as a circular array, a spherical array, another configuration, or a combination of configurations. In one embodiment, the beamformer module 114 is a delay-and-sum type of beamformer adapted to use delays between each array sensor to compensate for differences in the propagation delay of the source signal direction across the array. By adjusting the beamformer's weights and delays (as discussed below), source signals that originate from a desired direction (or location) (e.g., from the direction of a person that is speaking, such as a person providing instructions and/or input to a speech recognition system) are summed in phase, while other signals (e.g., noise, non-speech, etc.) undergo destructive interference. By adjusting or selecting the weights and/or delays of a delay-and-sum beamformer, the shape of its beamformed signal output can be controlled. Other types of beamformer modules may be utilized, as well.

Figure 3:
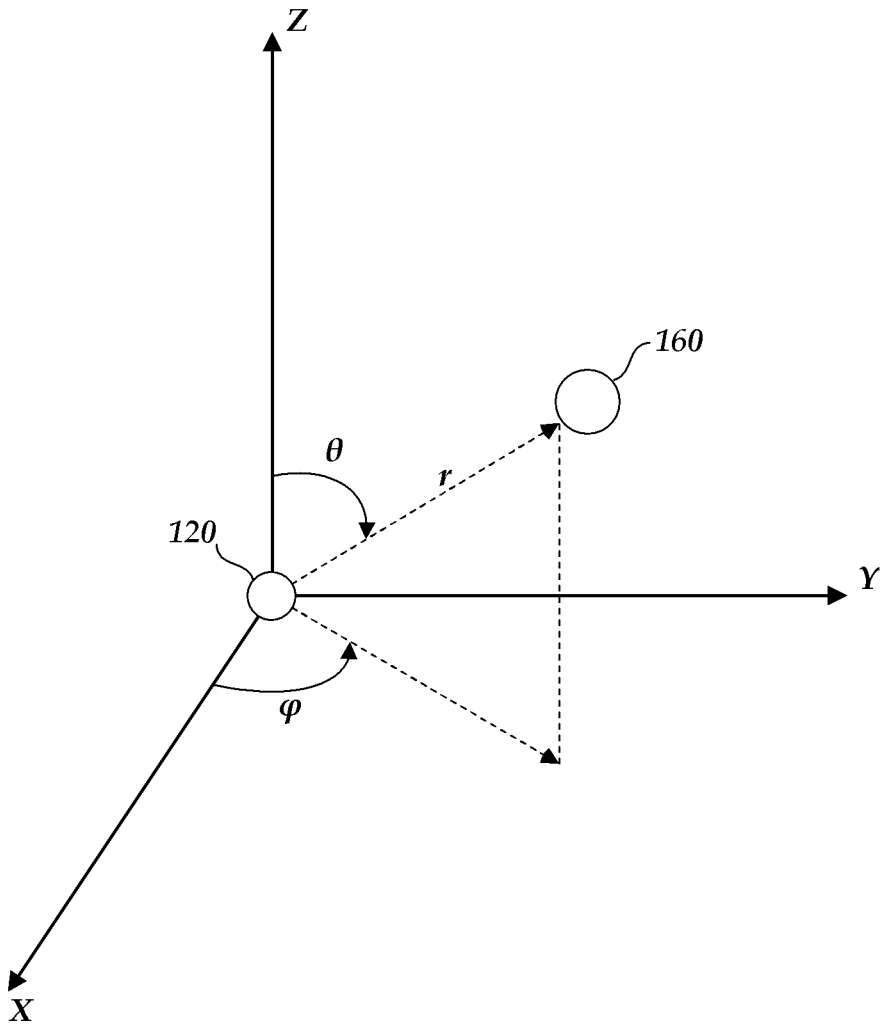
FIG. 3 is a diagram illustrating a spherical coordinate system according to an embodiment for specifying the location of a signal source relative to a sensor array.

The first sensor 130 can be positioned at a position $p_1$ relative to a center 122 of the sensor array 120, the second sensor 132 can be positioned at a position $p_2$ relative to the center 122 of the sensor array 120, and the Nth sensor 134 can be positioned at a position $p_N$ relative to the center 122 of the sensor array 120. The vector positions $p_1$, $p_2$, and $p_N$ can be expressed in spherical coordinates in terms of an azimuth angle $\phi$, a polar angle $\theta$, and a radius r, as shown in FIG. 3. Alternatively, the vector positions $p_1$, $p_2$, and $p_N$ can be expressed in terms of any other coordinate system.

Each of the sensors 130, 132, and 134 can comprise a microphone. In some embodiments, the sensors 130, 132, and 134 can be an omni-directional microphone having the same sensitivity in every direction. In other embodiments, directional sensors may be used.

Each of the sensors in sensor array 120, including sensors 130, 132, and 134, can be configured to capture input signals. In particular, the sensors 130, 132, and 134 can be configured to capture wavefields. For example, as microphones, the sensors 130, 132, and 134 can be configured to capture input signals representing sound. In some embodiments, the raw input signals captured by sensors 130, 132, and 134 are converted by the sensors 130, 132, and 134 and/or sensor array 120 (or other hardware, such as an analog-to-digital converter, etc.) to discrete-time digital input signals $x_1(k)$, $x_2(k)$, and $x_N(k)$, as shown on FIG. 2. Although shown as three separated signal channels for clarity, the data of input signals $x_1(k)$, $x_2(k)$, and $x_N(k)$ may be communicated by the sensor array 120 over a single data channel.

The discrete-time digital input signals $x_1(k)$, $x_2(k)$, and $x_N(k)$ can be indexed by a discrete sample index k, with each sample representing the state of the signal at a particular point in time. Thus, for example, the signal $x_1(k)$ may be represented by a sequence of samples $x_1(0)$, $x_1(1)$, . . . $x_1(k)$. In this example the index k corresponds to the most recent point in time for which a sample is available.

A beamformer module 114 may comprise filter blocks 140, 142, and 144 and summation module 150. Generally, the filter blocks 140, 142, and 144 receive input signals from the sensor array 120, apply filters (such as weights, delays, or both) to the received input signals, and generate weighted, delayed input signals as output. For example, the first filter block 140 may apply a first filter weight and delay to the first received discrete-time digital input signal $x_1(k)$, the second filter block 142 may apply a second filter weight and delay to the second received discrete-time digital input signal $x_2(k)$, and the Nth filter block 144 may apply an Nth filter weight and delay to the $N^{th}$ received discrete-time digital input signal $x_N(k)$. In some cases, a zero delay is applied, such that the weighted, delayed input signal is not delayed with respect to the input signal. In some cases, a unit weight is applied, such that the weighted, delayed input signal has the same amplitude as the input signal.

Summation module 150 may determine a beamformed signal y(k) based at least in part on the weighted, delayed input signals $y_1(k)$, $y_2(k)$, and $y_N(k)$. For example, summation module 150 may receive as inputs the weighted, delayed input signals $y_1(k)$, $y_2(k)$, and $y_N(k)$. To generate a spatially-filtered, beamformed signal y(k), the summation module 150 may simply sum the weighted, delayed input signals $y_1(k)$, $y_2(k)$, and $y_N(k)$. In other embodiments, the summation module 150 may determine a beamformed signal y(k) based on combining the weighted, delayed input signals $y_1(k)$, $y_2(k)$, and $y_N(k)$ in another manner, or based on additional information.

For simplicity, the manner in which beamformer module 114 determines beamformed signal y(k) has been described with respect to a single beamformed signal (corresponding to a single look direction). However, it should be understood that beamformer module 114 may determine any of a plurality of beamformed signals in a similar manner. Each beamformed signal y(k) is associated with a look direction for which a waveform detected by the sensor array from a direction other than the look direction is suppressed relative to a waveform detected by the sensor array from the look direction. The filter blocks 140, 142, and 144 and corresponding weights and delays may be selected to achieve a desired look direction. Other filter blocks and corresponding weights and delays may be selected to achieve the desired look direction for each of the plurality of beamformed signals. The beamformer module 114 can determine a beamformed signal y(k) for each look direction.

In the embodiment of FIG. 2, weighted, delayed input signals may be determined by beamformer module 114 by processing audio input signals $x_1(k)$, $x_2(k)$, and $x_N(k)$ from omni-directional sensors 130, 132, and 134. In other embodiments, directional sensors may be used. For example, a directional microphone has a spatial sensitivity to a particular direction, which is approximately equivalent to a look direction of a beamformed signal formed by processing a plurality of weighted, delayed input signals from omni-directional microphones. In such embodiments, determining a plurality of beamformed signals may comprise receiving a plurality of input signals from directional sensors. In some embodiments, beamformed signals may comprise a combination of input signals received from directional microphones and weighted, delayed input signals determined from a plurality of omni-directional microphones.

Turning now to FIG. 3, a spherical coordinate system according to an embodiment for specifying a look direction relative to a sensor array is depicted. In this example, the sensor array 120 is shown located at the origin of the X, Y, and Z axes. A signal source 160 (e.g., a user's voice) is shown at a position relative to the sensor array 120. In a spherical coordinate system, the signal source is located at a vector position r comprising coordinates (r, $\phi$, $\theta$), where r is a radial distance between the signal source 160 and the center of the sensor array 120, angle $\phi$ is an angle in the x-y plane measured relative to the x axis, called the azimuth angle, and angle $\theta$ is an angle between the radial position vector of the signal source 160 and the z axis, called the polar angle. Together, the azimuth angle $\phi$ and polar angle $\theta$ can be included as part of a single vector angle $\Theta=\{\phi,\theta\}$ that specifies the look direction of a given beamformed signal. In other embodiments, other coordinate systems may be utilized for specifying the position of a signal source or look direction of a beamformed signal. For example, the elevation angle may alternately be defined to specify an angle between the radial position vector of the signal source 160 and the x-y plane.

Figure 4:
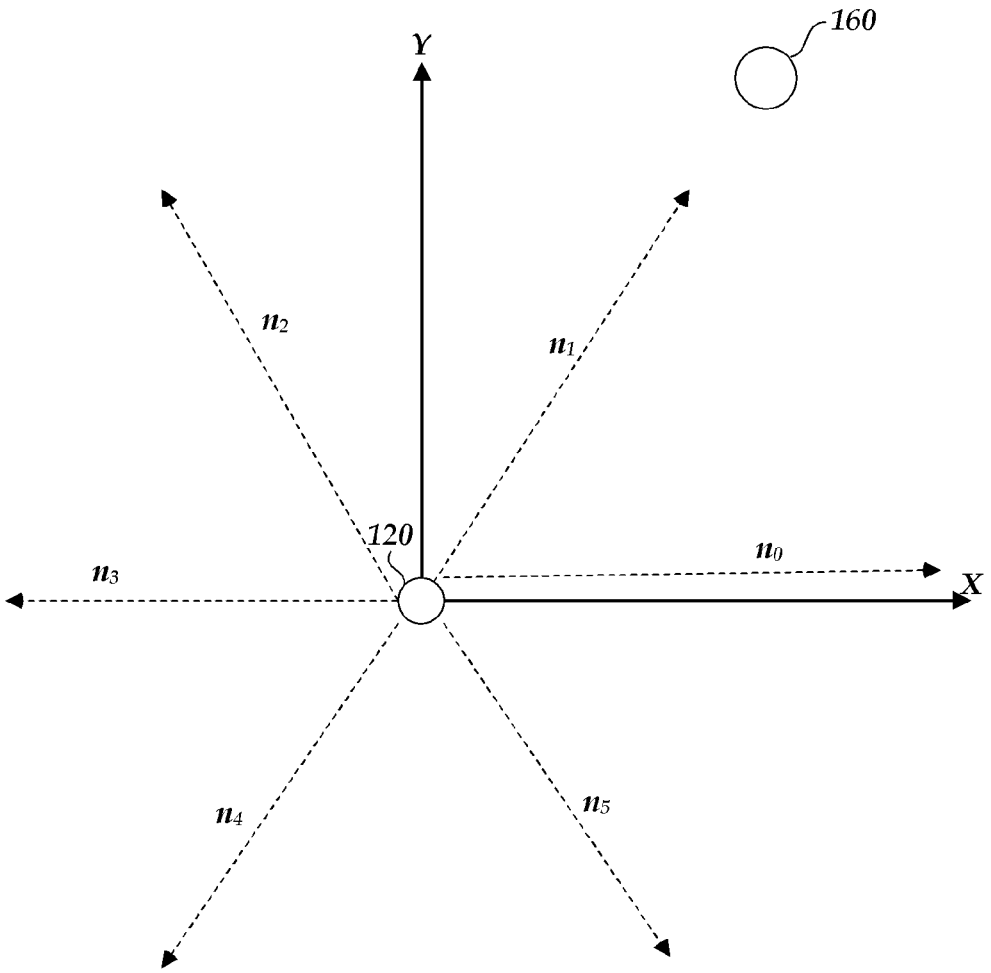
FIG. 4 is a diagram illustrating an example in two dimensions showing six beamformed signals and associated look directions.

Turning now to FIG. 4, a polar coordinate system is depicted for specifying look directions of each of a plurality of beamformed signals according to an embodiment. In the embodiment shown in FIG. 4, two-dimensional polar coordinates are depicted for ease of illustration. However, in other embodiments, the beamformed signals may be configured to have any look direction in a three-dimensional spherical coordinate system (e.g., the look direction for each of the plurality of beamformed signals may comprise an azimuth angle $\phi$ and polar angle $\theta$).

In the example of FIG. 4, there are six beamformed signals (N=6) determined from the input signals received by sensor array 120, where each beamformed signal corresponds to a different look direction. In other embodiments, there may be fewer or greater numbers of beamformed signals. Determining greater numbers of beamformed signals may provide for smaller angles between the look directions of neighboring beamformed signals, potentially providing for less error between the look direction of a selected beamformed signal and the actual direction of speech from a user 160. However, the reduced error would come at the cost of increased computational complexity. In FIG. 4, a zeroth beamformed signal comprises a look direction $n_0$ of approximately 0 degrees from the x axis. A first beamformed signal comprises a look direction $n_1$ of approximately 60 degrees from the x axis. A second beamformed signal comprises a look direction $n_2$ of approximately 120 degrees from the x axis. A third beamformed signal comprises a look direction $n_3$ of approximately 180 degrees from the x axis. A fourth beamformed signal comprises a look direction $n_4$ of approximately 240 degrees from the x axis. A fifth beamformed signal comprises a look direction $n_5$ of approximately 300 degrees from the x axis.

In the embodiment illustrated in FIG. 4, the look directions of each of the six beamformed signals are equally spaced apart. However, in other embodiments, other arrangements of look directions for a given number of beamformed signals may be chosen.

Beamformer module 114 may determine a plurality of beamformed signals based on the plurality of input signals received by sensor array 120. For example, beamformer module 114 may determine the six beamformed signals shown in FIG. 4. In one embodiment, the beamformer module 114 determines all of the beamformed signals, each corresponding to a different look direction. For example, the beamformer module may determine each of the beamformed signals by utilizing different sets of filter weights and/or delays. A first set of filter weights and/or delays (e.g., 140, 142, 144) may be used to determine a beamformed signal corresponding to a first look direction. Similarly, a second set of filter weights and/or delays (e.g., 140, 142, 144) may be used to determine a second beamformed signal corresponding to a second direction, etc. Such techniques may be employed by using an adaptive or variable beamformer that implements adaptive or variable beamforming techniques. In another embodiment, multiple beamformer modules (e.g., multiple fixed beamformer modules) are provided. Each beamformer module utilizes a set of filter weights and/or delays to determine a beamformed signal corresponding to a particular look direction. For example, six fixed beamformer modules may be provided to determine the six beamformed signal, each beamformed signal corresponding to a different look direction. Whether fixed or adaptive beamformers are used, the resulting plurality of beamformed signals may be represented in an array of numbers in the form y(n)(k):

$$\{y(1)(k),y(2)(k), \ldots ,y(N)(k)\},$$

where "k" is a time index and "n" is an audio stream index (or look direction index) corresponding to the nth beamformed signal (and nth look direction). For example, in the embodiment shown in FIG. 4, N=6.

The processing unit 102 may determine, for each of the plurality of beamformed signals, a plurality of signal features based on each beamformed signal. In some embodiments, each signal feature is determined based on the samples of one of a plurality of frames of a beamformed signal. For example, a signal-to-noise ratio may be determined for a plurality of frames for each of the plurality of beamformed signals. The signal features f may be determined for each of the plurality of beamformed signals for each frame, resulting in an array of numbers in the form f(n)(k):

$$\{f(1)(k),f(2)(k), \ldots ,f(N)(k)\},$$

where "k" is the time index and "n" is the audio stream index (or look direction index) corresponding to the nth beamformed signal.

In other embodiments, other signal features may be determined, including an estimate of at least one of a spectral centroid, a spectral flux, a 90th percentile frequency, a periodicity, a clarity, a harmonicity, or a 4 Hz modulation energy of the beamformed signals. For example, a spectral centroid generally provides a measure for a centroid mass of a spectrum. A spectral flux generally provides a measure for a rate of spectral change. A $90^{th}$ percentile frequency generally provides a measure based on a minimum frequency bin that covers at least 90% of the total power. A periodicity generally provides a measure that may be used for pitch detection in noisy environments. A clarity generally provides a measure that has a high value for voiced segments and a low value for background noise. A harmonicity is another measure that generally provides a high value for voiced segments and a low value for background noise. A 4 Hz modulation energy generally provides a measure that has a high value for speech due to a speaking rate. These enumerated signal features that may be used to determine f are not exhaustive. In other embodiments, any other signal feature may be provided that is some function of the raw beamformed signal data over a brief time window (e.g., typically not more than one frame).

The processing unit 102 may determine, for each of the pluralities of signal features (e.g., for each of the plurality of beamformed signals), a smoothed signal feature S based on a time-smoothed function of the signal features f over the plurality of frames. In some embodiments, the smoothed feature S is determined based on signal features over a plurality of frames. For example, the smoothed feature S may be based on as few as three frames of signal feature data to as many as a thousand frames or more of signal feature data. The smoothed feature S may be determined for each of the plurality of beamformed signals, resulting in an array of numbers in the form S(n)(k):

$$\{S(1)(k),S(2)(k), \ldots ,S(N)(k)\}$$

In general, signal measures (sometimes referred to as metrics) are statistics that are determined based on the underlying data of the signal features. Signal metrics summarize the variation of certain signal features that are extracted from the beamformed signals. An example of a signal metric can be the peak of the signal feature that denotes a maximum value of the signal over a longer duration. Such a signal metric may be smoothed (e.g., averaged, moving averaged, or weighted averaged) over time to reduce any short-duration noisiness in the signal features.

In some embodiments, a time-smoothing technique for determining a smoothed feature S can be obtained based on the following relationship:

$$S(k)=\text{alpha}*S(k-1)+(1-\text{alpha})*f(k)$$

In this example, alpha is a smoothing factor or time constant. According to the above, determining the smoothed feature S at a current frame (e.g., S(k)) comprises: determining a first product by multiplying the smoothed feature S corresponding to a previous frame (e.g., S(k−1)) by a first time constant (e.g., alpha); determining a second product by multiplying the signal feature at the current frame (e.g., f(k)) by a second time constant (e.g., (1−alpha)), wherein the first time constant and second time constant sum to 1; and adding the first product (e.g., alpha*S(k−1)) to the second product (e.g., (1−alpha)*f(k)).

In some embodiments, the smoothing technique may be applied differently depending on the feature. For example, another time-smoothing technique for determining a smoothed feature S can be obtained based on the following process:

If $(f(k)>S(k))$:

$$S(k)=\text{alpha_attack}*S(k-1)+(1-\text{alpha_attack})*f(k);$$

Else:

$$S(k)=\text{alpha_release}*S(k-1)+(1-\text{alpha_release})*f(k).$$

In this example, alpha_attack is an attack time constant and alpha_release is a release time constant. In general, the attack time constant is faster than the release time constant. Providing the attack time constant to be faster than the release time constant allows the smoothed feature S(k) to quickly track relatively-high peak values of the signal feature (e.g., when f(k)>S(k)) while being relatively slow to track relatively-low peak values of the signal feature (e.g., when f(k)<S(k)). In other embodiments, a similar technique could be used to track a minimum of a speech signal. In general, attack is faster when the feature f(k) is given a higher weight and the smoothed feature of the previous frame is given less weight. Therefore, a smaller alpha provides a faster attack.

The processing unit 102 may determine which of the beamformed signals corresponds to a maximum of the smoothed feature S. For example, the processing unit 102 may determine, for a given time index k, which beamformed signal corresponds to a maximum of the signal metrics based on the following process:

$$j=\arg\max\{S(1)(k),S(2)(k),\ldots,S(N)(k)\}$$

This process applies the argmax ( ) operator (e.g., that returns the maximum of the argument) on the smoothed signal feature S(n)(k) (e.g., a smoothed peak signal feature) as distinguished from the raw signal features f(n)(k).

Figure 5:
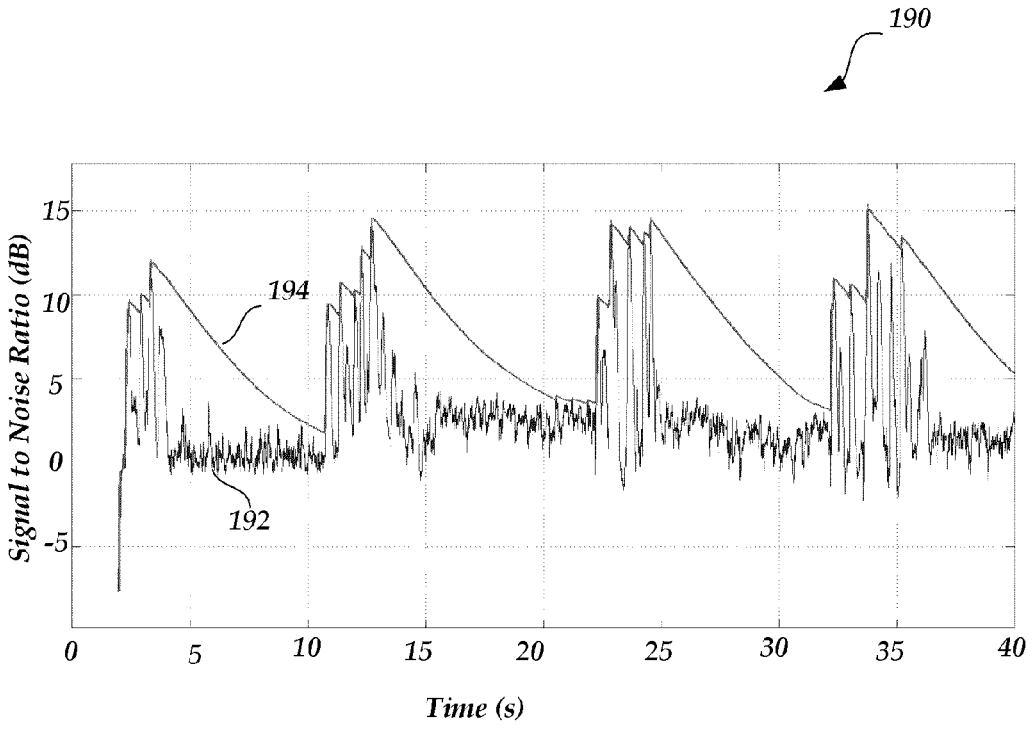
FIG. 5 is an example graph according to an embodiment illustrating a signal feature and a smoothed feature based on a signal to noise ratio as a function of time.

FIG. 5 illustrates a graph 190 depicting example values of a raw signal feature 192 and a smoothed peak signal feature 194 for a given beamformed signal over a time span of approximately 40 seconds. In the example of FIG. 5, the chosen signal feature is signal to noise ratio (SNR). FIG. 5 illustrates the raw signal feature 192 and smoothed peak signal feature 194 for just one given beamformed signal for simplicity, but it should be understood that such a graph could be provided for each of the plurality of beamformed signals.

As shown in FIG. 5, the smoothed peak signal feature 194 is based on a time-smoothed function of the raw signal feature 192 over a plurality of frames. For example, as can be seen at approximately 3-4 seconds, when raw signal feature 192 reaches a relatively high peak, the smoothed peak signal feature 194 quickly tracks the peak of the raw signal feature 192 and reaches the same peak value. In some embodiments, the smoothed peak signal feature 194 can be configured to quickly track the peak of the raw signal feature 192 by choosing an appropriate value of the alpha_attack time constant. There may be a higher degree of confidence in the accuracy of a high SNR signal feature than a lower SNR signal feature, and choosing an appropriate value of the alpha_attack time constant reflects the higher degree of confidence in the accuracy of the higher SNR signal feature value.

As can be seen between approximately 4 seconds and 11 seconds, the peak of the raw signal feature 192 is less than the previously-determined values of the smoothed peak signal feature 194. In this case, the smoothed peak signal feature 194 does not quickly track the smaller peaks of the raw signal features 192 and is slow to reach the same peak value. For example, it is not until approximately the 10 second point that the smoothed peak signal feature 194 converges with the peak of the raw signal feature 192. In some embodiments, the smoothed peak signal feature 194 can be configured to slowly track the peak of the raw signal feature 192 by choosing an appropriate value of the alpha_release time constant. There may be a lower degree of confidence in the accuracy of a small SNR signal feature than a higher SNR signal feature, and choosing an appropriate value of the alpha_release time constant reflects the lower degree of confidence in the accuracy of the smaller SNR signal feature value.

Beamformed Signal Selection Process

Figure 6:
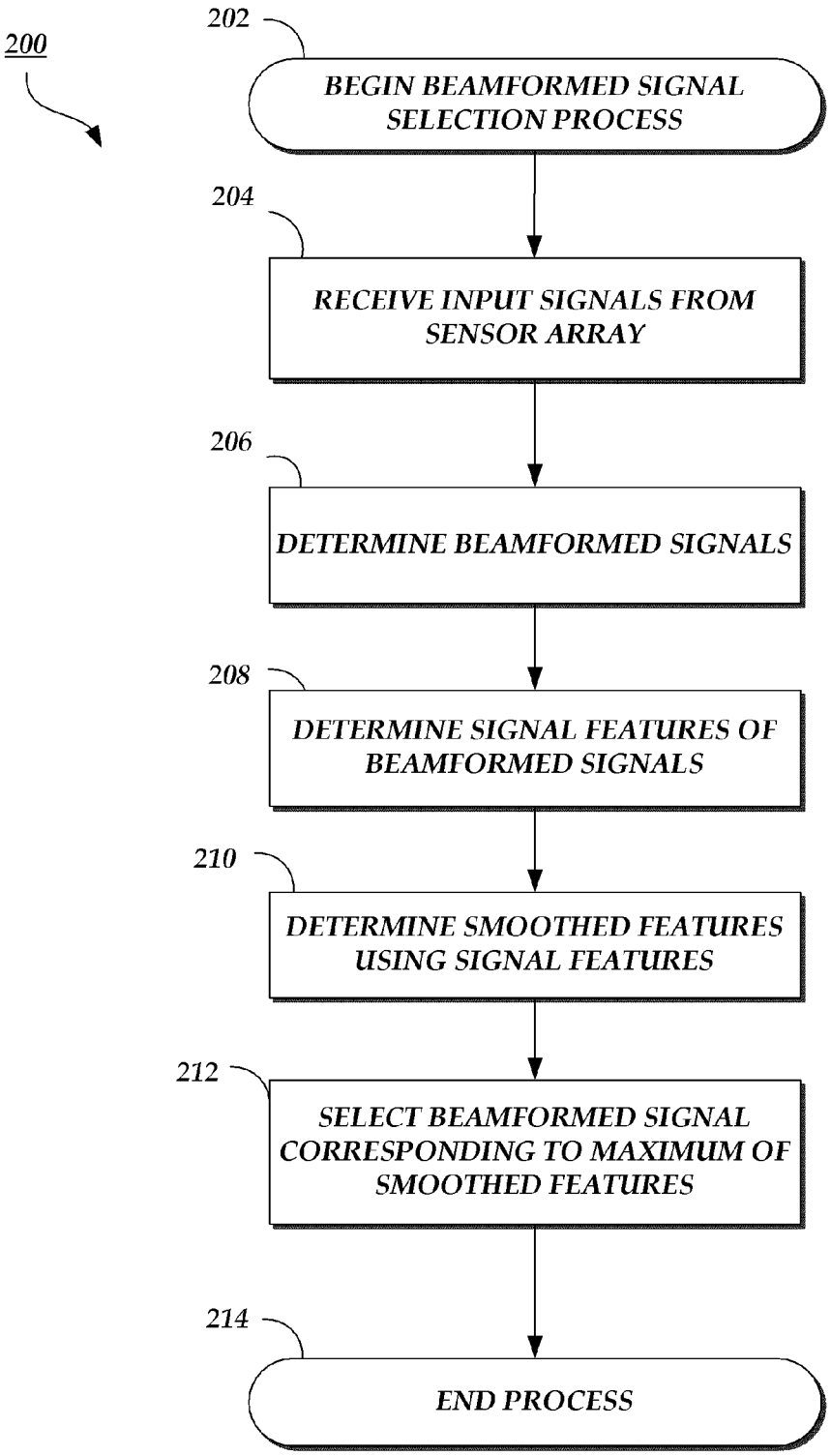
FIG. 6 is a flow diagram illustrating an embodiment of a beamformed signal selection routine.

Turning now to FIG. 6, an example process 200 for performing a beamformed signal selection process is depicted. The process 200 may be performed, for example, by the beamformer module 114 and processing unit 102 of the device 100 of FIG. 1. Process 200 begins at block 202. A beamforming module receives input signals from a sensor array at block 204. For example, the sensor array may include a plurality of sensors as shown in FIG. 2. Each of the plurality of sensors can determine an input signal. For example, each of the plurality of sensors can comprise a microphone, and each microphone can detect an audio signal. The plurality of sensors in the sensor array may be arranged at any position. A beamforming module can receive each of the plurality of input signals.

Next, at block 206, a plurality of weighted, delayed input signals are determined using the plurality of input signals. Each of the plurality of weighted, delayed input signals corresponds to a look direction for which a waveform detected by the sensor array from a direction other than the look direction is suppressed relative to a waveform detected by the sensor array from the look direction. In some embodiments, weighted, delayed input signals may be determined by beamformer module 114 by processing audio input signals from omni-directional sensors 130, 132, and 134. In other embodiments, directional sensors may be used. For example, a directional microphone has a spatial sensitivity to a particular direction, which is approximately equivalent to a look direction of a beamformed signal formed by processing a plurality of weighted, delayed input signals from omni-directional microphones. In such embodiments, determining a plurality of beamformed signals may comprise receiving a plurality of input signals from directional sensors. In some embodiments, beamformed signals may comprise a combination of input signals received from directional microphones and weighted, delayed input signals determined from a plurality of omni-directional microphones.

At block 208, signal features may be determined using the beamformed signals. For example, for each of the plurality of beamformed signals, a plurality of signal features based on the beamformed signal may be determined. In one embodiment, a signal-to-noise ratio may be determined for a plurality of frames of the beamformed signal. In other embodiments, other signal features may be determined, including an estimate of at least one of a spectral centroid, a spectral flux, a 90th percentile frequency, a periodicity, a clarity, a harmonicity, or a 4 Hz modulation energy of the beamformed signals.

In some embodiments, signal features may depend on output from a voice activity detector (VAD). For example, in some embodiments, the signal-to-noise ratio (SNR) signal feature may depend on a VAD output information. In particular, a VAD may output, for each frame, information relating to whether the frame contains speech or a user's voice. For example, if a particular frame contains user speech, a VAD may output a score that indicates the likelihood that the frame includes speech. The score can correspond to a probability. In some embodiments, the score has a value between 0 and 1, between 0 and 100, or between a predetermined minimum and maximum value. In some embodiments, a flag may be set as the output or based upon the output of the VAD. For example, the flag may indicate a 1 or a "yes" signal when it is likely that the frame includes user speech; similarly, the flag may indicate a 0 or "no" when it is likely that the frame does not contain user speech. To determine SNR, frames marked as containing speech by the VAD may be counted as signal, and frames marked as not containing speech by the VAD may be counted as noise. In one embodiment, to determine SNR, processing unit 102 may determine a first sum by adding up a signal energy of each frame containing user speech. Processing unit 102 may determine a second sum by adding up a signal energy of each frame containing noise. Processing unit 102 may determine SNR by determining the ratio of the first sum to the second sum.

At block 210, a smoothed feature may be determined using the signal features. For example, for each of the pluralities of signal features, a smoothed feature may be determined based on a time-smoothed function of the signal features. In some embodiments, time smoothing may be performed according to the process as described below with respect to FIG. 7. In other embodiments, the smoothed feature may generally be configured to track the peaks of the signal-to-noise ratio signal features but also include a time-smoothing function (e.g., a moving average) to not immediately track the peaks of the signal-to-noise ratio signal features when the peaks of the signal-to-noise ratio signal features drop relative to previous peaks.

At block 212, a beamformed signal corresponding to a maximum of the smoothed feature may be selected. For example, which of the beamformed signals corresponds to a maximum of the smoothed feature may be determined, and the beamformed signal corresponding to the maximum of the smoothed feature may be selected for further processing (e.g., speech recognition). In other embodiments, a plurality of beamformed signals corresponding to a plurality of smoothed features may be selected. For example, in some embodiments, two smoothed features may be selected corresponding to the top two smoothed features. In some embodiments, three smoothed features may be selected corresponding to the top three smoothed features. For example, the beamformed signals may be ranked based on their corresponding smoothed features, and a plurality of beamformed signals may be selected for further processing based on the rank of their smoothed features. In some embodiments, the beamformed signal having the greatest smoothed feature value is selected only if it is also determined that the beamformed signal includes voice (or speech). Voice and/or speech detection may be detected in a variety of ways, including using a voice activity detector, such as the voice activity detector described below with respect to FIG. 8. In another embodiment, the process can first determine whether candidate beamformed signals include voice and/or speech and then select a beamformed signal from only the candidate beamformed signals that do include voice and/or speech. For example, the process 200 can determine whether the beamformed signals include voice and/or speech after block 206 and before block 208. Subsequent blocks 210, 212 in such embodiment may be performed on only the candidate beamformed signals that do include voice and/or speech. In another embodiment, the process 200 can first determine smoothed features of candidate beamformed signals. The process 200 can then determine whether the beamformed signal having the smoothed feature with the greatest value includes voice and/or speech. If it does, the beamformed signal having the smoothed feature with the greatest value can be selected for further processing. If it doesn't, the process 200 can determine whether the beamformed signal having the next-highest smoothed feature value includes voice and/or speech. If it does, that beamformed signal can be selected for further processing. If not, the process 200 can continue to evaluate beamformed signals in decreasing order of smoothed feature value until a beamformed signal that includes voice and/or speech is determined. Such beamformed signal may be selected for further processing.

The beamformed signal selection process 200 ends at block 214. However, it should be understood that the beamformed signal selection process may be performed continuously and repeated indefinitely. In some embodiments, the beamformed signal selection process 200 is only performed when voice activity is detected (e.g., by a voice activity detector (VAD)), as described below with respect to FIG. 8.

Figure 7:
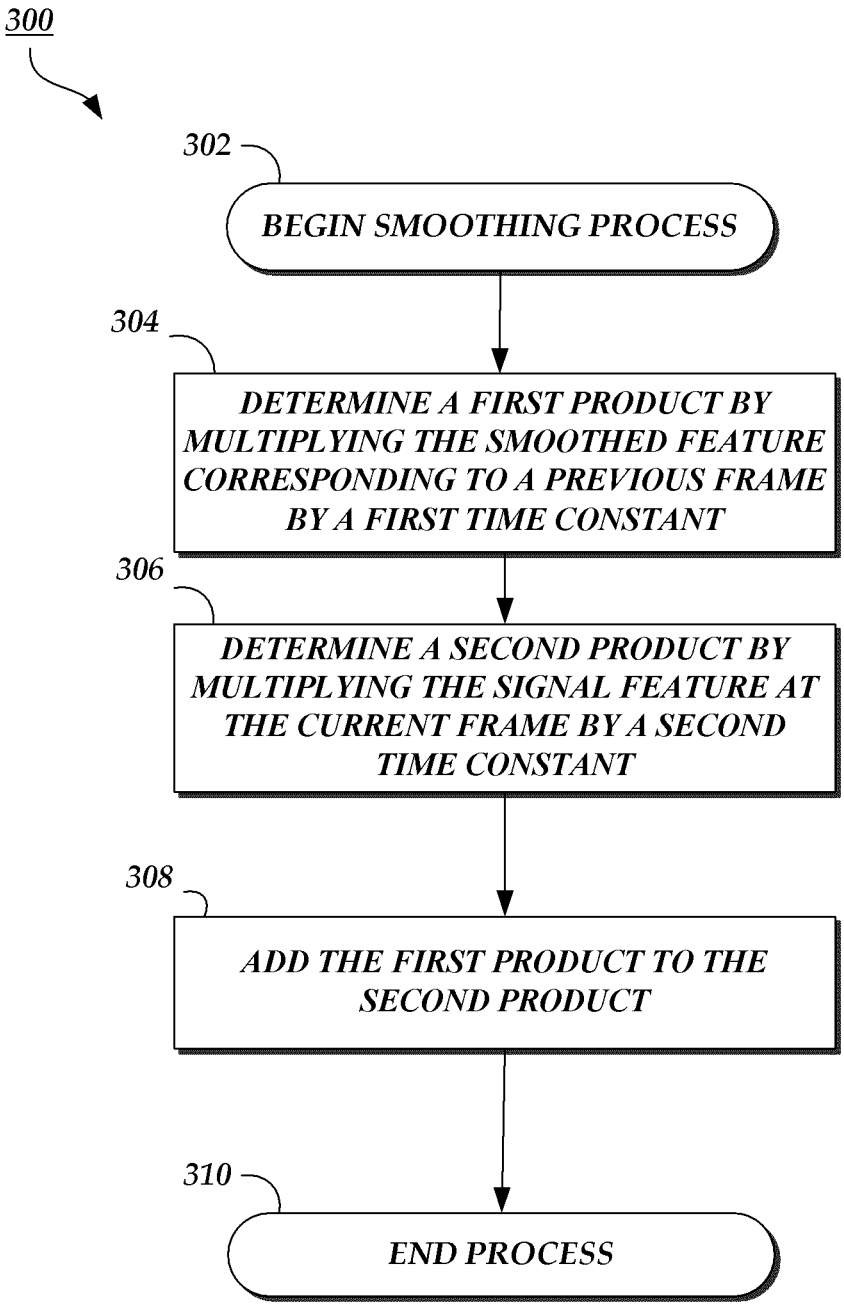
FIG. 7 is a flow diagram illustrating an embodiment of a routine for a time-smoothing function of a signal feature.

FIG. 7 illustrates an example process 300 for performing time smoothing of signal features to determine a smoothed feature. The process 300 may be performed, for example, by the processing unit 102 and data store 124 of the device 100 of FIG. 1. Process 300 begins at block 302.

At block 304, a first product is determined by multiplying a smoothed feature corresponding to a previous frame by a first time constant. For example, processing unit 102 may determine a first product by multiplying a smoothed feature corresponding to a previous frame by a first time constant.

At block 306, a second product is determined by multiplying the signal feature at a current frame by a second time constant. For example, processing unit 102 may determine the second product by multiplying the signal feature at a current frame by a second time constant. In some embodiments, the first time constant and second time constant sum to 1.

At block 308, the first product is added to the second product. For example, processing unit 102 may add the first product to the second product to determine the smoothed feature at a current frame. The time-smoothing process 300 ends at block 310.

In the example process 300 of FIG. 7, the value of the smoothed feature at a current frame depends on the value of the smoothed feature at a previous frame and the value of the signal feature at the current frame. In other embodiments, the value of the smoothed feature may depend on any previous or current value of the smoothed feature as well as any previous or current value of the signal feature. For example, in addition to depending on the value of the smoothed feature at the previous frame (e.g., S[k−1]), the value of the smoothed feature at a current frame (e.g., S[k]) may also depend on the value of the smoothed feature at the second previous frame (e.g., S[k−2]), third previous frame (e.g., S[k−3]), as well as the value of the smoothed feature at any other previous frame (e.g., S[k-n]).

Figure 8:
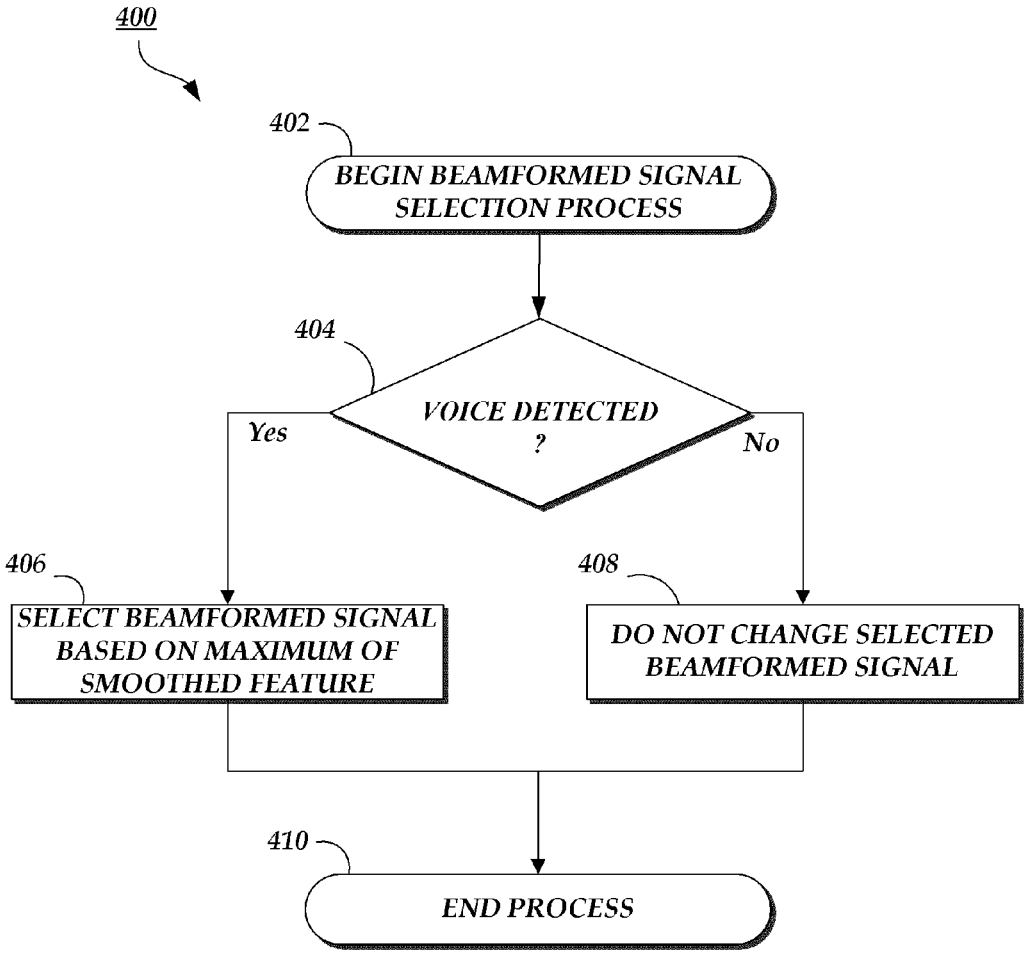
FIG. 8 is a flow diagram illustrating an embodiment of a beamformed signal selection routine based on voice detection.

FIG. 8 illustrates an example beamformed signal selection process 400 for performing time smoothing of signal features to determine a smoothed feature. The process 400 may be performed, for example, by the processing unit 102, a data store 124, and a voice activity detector (not shown) of the device 100 of FIG. 1. Process 400 begins at block 402.

At block 404, it is determined whether voice is present. For example, the processing unit 102 may determine whether a voice is present in at least one input signal, weighted, delayed input signal, or beamformed signals. In some embodiments, a voice activity detector (VAD) determines whether a voice is present in at least one of the input signals, weighted, delayed input signals, or beamformed signals. The VAD may determine a score or set a flag to indicate the presence or absence of a voice.

If a voice is detected (for example, the score is greater than a threshold value or the flag is set), the beam selection process may continue to block 406. At block 406, a beamformed signal may be selected based on a maximum of a smoothed feature. For example, a beamformed signal may be selected according to beamformed signal selection process 200.

If voice is not detected, the beamformed signal selection process may continue to block 408. At block 408, the selected beamformed signal is not changed. For example, the processing unit 102 continues to use the previously-selected beamformed signal as the selected beamformed signal. The processing unit 102 may conserve computing resources by not running the beamformed signal selection process 200 in the absence of a detected voice. In addition, continuing to use the previously-selected beamformed signal in the absence of a detected voice reduces the likelihood of switching selection of a beamformed signal to focus on non-speech sources. The beamformed signal selection process 400 ends at block 410. However, it should be understood that the beamformed signal selection process 400 may be performed continuously and repeated indefinitely.

In the example process 400, the VAD is tuned to determine whether a user's voice is present in any of the input signals or beamformed signals (e.g., the VAD is tuned to recognize speech). In other embodiments, example process 400 may remain the same, except the VAD may be tuned to a target signal other than user speech. For example, in a pet robot device configured to follow its owner, a VAD may be configured to detect a user's footsteps as its target signal.

TERMINOLOGY

Depending on the embodiment, certain acts, events, or functions of any of the processes or algorithms described herein can be performed in a different sequence, can be added, merged, or left out altogether (e.g., not all described operations or events are necessary for the practice of the algorithm). Moreover, in certain embodiments, operations or events can be performed concurrently, e.g., through multi-threaded processing, interrupt processing, or multiple processors or processor cores or on other parallel architectures, rather than sequentially.

The various illustrative logical blocks, modules, routines and algorithm steps described in connection with the embodiments disclosed herein can be implemented as electronic hardware, computer software, or combinations of both. To clearly illustrate this interchangeability of hardware and software, various illustrative components, blocks, modules and steps have been described above generally in terms of their functionality. Whether such functionality is implemented as hardware or software depends upon the particular application and design constraints imposed on the overall system. The described functionality can be implemented in varying ways for each particular application, but such implementation decisions should not be interpreted as causing a departure from the scope of the disclosure.

The steps of a method, process, routine, or algorithm described in connection with the embodiments disclosed herein can be embodied directly in hardware, in a software module executed by a processor, or in a combination of the two. A software module can reside in RAM memory, flash memory, ROM memory, EPROM memory, EEPROM memory, registers, hard disk, a removable disk, a CD-ROM, or any other form of a non-transitory computer-readable storage medium. An exemplary storage medium can be coupled to the processor such that the processor can read information from, and write information to, the storage medium. In the alternative, the storage medium can be integral to the processor. The processor and the storage medium can reside in an ASIC. The ASIC can reside in a user terminal. In the alternative, the processor and the storage medium can reside as discrete components in a user terminal.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Conjunctive language such as the phrase "at least one of X, Y and Z," unless specifically stated otherwise, is to be understood with the context as used in general to convey that an item, term, etc. may be either X, Y, or Z, or a combination thereof. Thus, such conjunctive language is not generally intended to imply that certain embodiments require at least one of X, at least one of Y and at least one of Z to each be present.

While the above detailed description has shown, described and pointed out novel features as applied to various embodiments, it can be understood that various omissions, substitutions and changes in the form and details of the devices or algorithms illustrated can be made without departing from the spirit of the disclosure. As can be recognized, certain embodiments of the inventions described herein can be embodied within a form that does not provide all of the features and benefits set forth herein, as some features can be used or practiced separately from others. The scope of certain inventions disclosed herein is indicated by the appended claims rather than by the foregoing description. All changes which come within the meaning and range of equivalency of the claims are to be embraced within their scope.

What is claimed is:

1. An apparatus comprising:

a microphone array comprising a plurality of microphones and configured to determine a plurality of audio input signals;

one or more processors in communication with the microphone array, the one or more processors configured to:

determine a plurality of beamformed audio signals based on the plurality of audio input signals, each of the plurality of beamformed audio signals corresponding to a direction, the plurality of beamformed audio signals comprising a first beamformed audio signal;

determine, for the first beamformed audio signal, a signal feature value for a signal feature;

obtain a previously determined signal feature value for a previously determined beamformed audio signal, wherein the previously determined signal feature value corresponds to the signal feature;

determine, for the first beamformed audio signal, a smoothed signal feature value based on the signal feature value and the previously determined signal feature value;

determine, for the first beamformed audio signal, a score corresponding to a presence of speech in the first beamformed audio signal; and select first beamformed audio signal for further processing using the smoothed signal feature value and the score.

2. The apparatus of claim 1, wherein the plurality of beamformed audio signals comprises a second beamformed audio signal, and wherein the one or more processors are further configured to:

determine, for the second beamformed audio signal, a second signal feature value for the signal feature;

determine, for the second beamformed audio signal, a second smoothed signal feature value based on the second signal feature value; and wherein the first beamformed audio signal is selected for further processing using the second smoothed signal feature value.

3. The apparatus of claim 1, wherein the one or more processors being configured to determine the signal feature value comprises the one or more processors being configured to generate an estimate of at least one of a signal-to-noise ratio (SNR), a spectral centroid, a spectral flux, a 90th percentile frequency, a periodicity, a clarity, a harmonicity, or a 4 Hz modulation energy of the first beamformed audio signal.

4. The apparatus of claim 1, wherein the one or more processors being configured to determine the smoothed signal feature value comprises the one or more processors being configured to:

determine a first product by multiplying the previously determined signal feature value by a first time constant, wherein the previously determined signal feature value comprises a smoothed signal feature value for the signal feature;

determine a second product by multiplying the signal feature value by a second time constant, wherein the first time constant and second time constant sum to 1; and add the first product to the second product.

5. The apparatus of claim 1, wherein the plurality of beamformed audio signals comprises a second beamformed audio signal, and wherein the one or more processors are further configured to:

determine, for the second beamformed audio signal, a second signal feature value for the signal feature;

determine, for the second beamformed audio signal, a second smoothed signal feature value based on the second signal feature value; and determine that the second beamformed audio signal does not include speech.

6. The apparatus of claim 1, wherein the one or more processors are further configured to determine the score after determining the signal feature value.

7. The apparatus of claim 1, wherein the further processing comprises speech recognition.

8. A method comprising:

receiving a plurality of audio input signals from a microphone array comprising a plurality of microphones;

determining a plurality of beamformed audio signals based on the plurality of audio input signals, each of the plurality of beamformed audio signals corresponding to a direction, the plurality of beamformed audio signals comprising a first beamformed audio signal;

determining, for the first beamformed audio signal, a signal feature value for a signal feature;

obtaining a previously determined signal feature value for a previously determined beamformed audio signal, wherein the previously determined signal feature value corresponds to the signal feature;

determining, for the first beamformed audio signal, a smoothed signal feature value based on the signal feature value and the previously determined signal feature value; and selecting the first beamformed audio signal for further processing using the smoothed signal feature value.

9. The method of claim 8, wherein the plurality of beamformed audio signals comprises a second beamformed audio signal, further comprising:

determining, for the second beamformed audio signal, a second signal feature value for the signal feature;

determining, for the second beamformed audio signal, a second smoothed signal feature value based on the second signal feature value; and wherein the first beamformed audio signal is selected for further processing using the second smoothed signal feature value.

10. The method of claim 8, wherein determining the signal feature value comprises determining an estimate of at least one of a signal-to-noise ratio (SNR), a spectral centroid, a spectral flux, a 90th percentile frequency, a periodicity, a clarity, a harmonicity, or a 4 Hz modulation energy of the first beamformed audio signal.

11. The method of claim 8, wherein determining the signal feature value comprises determining the signal feature value that corresponds to a frame of the first beamformed audio signal.

12. The method of claim 8, wherein determining the smoothed signal feature value comprises:

determining a first product by multiplying the previously determined signal feature value by a first time constant, wherein the previously determined signal feature value comprises a smoothed signal feature value for the signal feature;

determining a second product by multiplying the signal feature value by a second time constant, wherein the first time constant and second time constant sum to 1; and adding the first product to the second product.

13. The method of claim 8, further comprising:

determining, for the first beamformed audio signal, a score corresponding to a presence of speech in the first beamformed audio signal; and wherein selecting the first beamformed audio signal comprises selecting the first beamformed audio signal using the smoothed signal feature value and the score.

14. The method of claim 13, further comprising performing speech recognition on the selected first beamformed audio signal.

15. One or more non-transitory computer-readable storage media comprising computer-executable instructions to:

receive a plurality of audio input signals from a microphone array comprising a plurality of microphones;

determine a plurality of beamformed audio signals based on the plurality of audio input signals, each of the plurality of beamformed audio signals corresponding to a direction, the plurality of beamformed audio signals comprising a first beamformed audio signal;

determine, for the first beamformed audio signal, a signal feature value for a signal feature;

obtain a previously determined signal feature value for a previously determined beamformed audio signal, wherein the previously determined signal feature value corresponds to the signal feature;

determine, for the first beamformed audio signal, a smoothed signal feature value based on the signal feature value and the previously determined signal feature value; and select the first beamformed audio signal for further processing using the smoothed signal feature value.

16. The one or more non-transitory computer-readable storage media of claim 15, wherein the plurality of beamformed audio signals comprises a second beamformed audio signal, further comprising computer-executable instructions to:

determine, for the second beamformed audio signal, a second signal feature value for the signal feature;

determine, for the second beamformed audio signal, a second smoothed signal feature value based on the second signal feature value; and wherein the instructions are configured to select the first beamformed audio signal for further processing using the second smoothed signal feature value.

17. The one or more non-transitory computer-readable storage media of claim 15, wherein the computer-executable instructions to determine the signal feature value comprises computer-executable instructions to determine an estimate of at least one of a signal-to-noise ratio (SNR), a spectral centroid, a spectral flux, a 90th percentile frequency, a periodicity, a clarity, a harmonicity, or a 4 Hz modulation energy of the first beamformed audio signals.

18. The one or more non-transitory computer-readable storage media of claim 15, wherein the computer-executable instructions to determine the signal feature value comprises computer-executable instructions to determine the signal feature value that corresponds to a frame of the first beamformed audio signal.

19. The one or more non-transitory computer-readable storage media of claim 15, wherein the computer-executable instructions are configured to determine the smoothed feature by:

determining a first product by multiplying the previously determined signal feature value by a first time constant, wherein the previously determined signal feature value comprises a smoothed signal feature value for the signal feature;

determining a second product by multiplying the signal feature value by a second time constant, wherein the first time constant and second time constant sum to 1; and adding the first product to the second product.

20. The one or more non-transitory computer-readable storage media of claim 15, further comprising computer-executable instructions to:

determine, for the first beamformed audio signal, a score corresponding to a presence of speech in the first beamformed audio signal; and wherein the instructions are configured to select the first beamformed audio signal for further processing using the smoothed signal feature value and the score.

21. The one or more non-transitory computer-readable storage media of claim 20, further comprising computer-executable instructions to perform speech recognition on the selected first beamformed audio signal.

* * * * *